US007879776B2

(12) United States Patent
Patel et al.

(10) Patent No.: US 7,879,776 B2
(45) **Date of Patent: *Feb. 1, 2011**

(54) HIGH PERFORMANCE LUBRICANT ADDITIVES

(76) Inventors: Krupal Patel, 18909 Lloyd Cir., #223, Dallas, TX (US) 75252; Pranesh B. Aswath, 2674 Juniper La., Grapevine, TX (US) 76051; Harold Shaub, 1112 Hidden Ridge Dr. #1071, Irving, TX (US) 75038; Ronald L. Elsenbaumer, 2325 Stone Bridge Dr., Arlington, TX (US) 76006

( * ) Notice: Subject to any disclaimer, the term of this patent is extended or adjusted under 35 U.S.C. 154(b) by 799 days.

This patent is subject to a terminal disclaimer.

(21) Appl. No.: 11/259,635

(22) Filed: Oct. 26, 2005

(65) Prior Publication Data

US 2007/0093397 A1 Apr. 26, 2007

(51) Int. Cl.
*C10M 135/18* (2006.01)
*C10M 137/10* (2006.01)
*C07F 9/02* (2006.01)

(52) U.S. Cl. ..... 508/363; 508/368; 508/371; 508/433; 508/165; 556/13; 556/24

(58) Field of Classification Search ..... 508/363, 508/368, 369, 371, 433, 165, 171, 172; 556/13, 556/14, 24, 25
See application file for complete search history.

(56) References Cited

U.S. PATENT DOCUMENTS 2,884,431 A 4/1959 Smith et al.
2,959,544 A 11/1960 Smith et al.
4,130,492 A 12/1978 Longo et al.
4,313,761 A 2/1982 Joyce, III et al.
4,832,859 A 5/1989 Basset et al.
5,133,886 A 7/1992 Hata
5,385,683 A 1/1995 Ransom
5,595,962 A 1/1997 Caporiccia et al.
5,641,731 A 6/1997 Baumgart et al.
5,767,045 A 6/1998 Ryan
5,877,128 A 3/1999 Greer
6,258,758 B1 * 7/2001 Greer ..... 508/113
6,413,918 B1 7/2002 Beatty et al.

(Continued)

FOREIGN PATENT DOCUMENTS

EP 856570 A2 * 8/1998
GB 804777 11/1958

OTHER PUBLICATIONS

PCT International Search Report in PCT/US04/34272 dated Sep. 1, 2005.

(Continued)

*Primary Examiner*—Glenn A Caldarola
*Assistant Examiner*—Vishal Vasisth
(74) *Attorney, Agent, or Firm*—Parks IP Law LLC; Collen A. Beard, Esq.

(57) ABSTRACT

A lubricant additive produced by the process comprising mixing an organophosphate and an organofluorine compound and reacting the organophosphate and the organofluorine compound to produce a reaction mixture comprising the lubricant additive. Also, a lubricant produced by the process comprising forming a reaction mixture by reacting an organophosphate and an organofluorine and adding at least a portion of the reaction mixture to a lubricant base.

25 Claims, 17 Drawing Sheets

| Structure Number | Possible structures | Theoretical Peaks in $^{31}P$ NMR (ppm) | References |
|---|---|---|---|
| 1 | $[(RO)_2P(S)S]_2Zn$ Neutral ZDDP (secondary) | 94, 102-93, 95.8 | 1,5 |
| 2 | $(RS)_3P(S)$, R>$CH_3$ | 92.9, 90-98 | 4,2 |
| 3 | $(RO)(R'S)P(O)SZn^{+}$ | 68-90, | 2 |
| 4 | $(RO)_2(RS)PS$ , R>$CH_3$ | 92-98, 94.9,85-93 | 2,4,1 |
| 5 | Basic ZDDP | 102-110, 100(sec.) | 1 |
| 6 | >$P(S)SZn^{+}$ | 99-104 | 2 |
| 7 | $(RO)_2P(S)(SR)$ | 100 | 3 |
| | $[(RO)_2P(S)S]_2Zn$ Neutral ZDDP (primary) | 104 | 3 |
| 8 | $R(R'S)_2PS$ , R=$CH_3$, R'>$CH_3$ | -74+-3.0 | 4 |
| 9 | $(RO)_3PS$, R=$CH_3$, R = any alkyl | -73, 50-82 | 4,2 |
| 10 | $MeP(S)Cl_2$ | -79.8 | 4 |
| 11 | $(RO)_2(S)PSP(S)(OR)_2$ | 76-83,78.4-83.4 | 2,5 |
| 12 | >P(S)(SH) | 78-83 | 2 |
| | $(RO)(R'S)P(O)SZn^{+}$ | 68-90 | 2 |
| 13 | $SPH(OCH_3)_2$ | 74 | 5 |

U.S. PATENT DOCUMENTS

| | | | | |
|---|---|---|---|---|
| 6,541,430 | B1 | 4/2003 | Beatty | |
| 6,642,186 | B2 | 11/2003 | Beatty et al. | |
| 6,734,320 | B2 | 5/2004 | Beatty | |
| 6,764,984 | B2 | 7/2004 | Beatty | |
| 2003/0139300 | A1 | 7/2003 | Beatty | |
| 2005/0119135 | A1 * | 6/2005 | Shaub et al. | 508/165 |

OTHER PUBLICATIONS

International Search Report and Written Opinion Issued for PCT/US2006/40823 dated Apr. 24, 2007.

International Search Report and Written Opinion issued for PCT/US2008/079511; Dated: Nov. 19, 2008; 11 Pages.

* cited by examiner

| Structure Number | Possible structures | Theoretical Peaks in $^{31}P$ NMR (ppm) | References |
|---|---|---|---|
| 1 | $[(RO)_2P(S)S]_2Zn$ Neutral ZDDP (secondary) | 94, 102-93, 95.8 | 1,5 |
| 2 | $(RS)_3P(S)$, R>$CH_3$ | 92.9, 90-98 | 4,2 |
| 3 | $(RO)(R'S)P(O)SZn^-$ | 68-90, | 2 |
| 4 | $(RO)_2(RS)PS$ , R>$CH_3$ | 92-98, 94.9,85-93 | 2,4,1 |
| 5 | Basic ZDDP | 102-110, 100(sec.) | 1 |
| 6 | $>P(S)SZn^-$ | 99-104 | 2 |
| 7 | $(RO)_2P(S)(SR)$ | 100 | 3 |
| | $[(RO)_2P(S)S]_2Zn$ Neutral ZDDP (primary) | 104 | 3 |
| 8 | $R(R'S)_2PS$ , R=$CH_3$, R'>$CH_3$ | -74+-3.0 | 4 |
| 9 | $(RO)_3PS$, R=$CH_3$, R = any alkyl | -73, 50-82 | 4,2 |
| 10 | $MeP(S)Cl_2$ | -79.8 | 4 |
| 11 | $(RO)_2(S)PSP(S)(OR)_2$ | 76-83,78.4-83.4 | 2,5 |
| 12 | $>P(S)(SH)$ | 78-83 | 2 |
| | $(RO)(R'S)P(O)SZn^-$ | 68-90 | 2 |
| 13 | $SPH(OCH_3)_2$ | 74 | 5 |

FIGURE 1

Structure 1 (Neutral ZDDP)

R >$CH_3$

Structure 2

Structure 3

R >$CH_3$

Structure 4

Structure 5 Many possible isomers of Basic ZDDP

STRUCTURE 20

M = Fe, Zr, Al, Ti, Mo ....

Fluorinated Metal Complexes of ZDDP

Structure 1

Structure 2

Structure 3

Structure 4

Structure 5

Structure 6

Structure 7

Structure 8

Figure 3B - Cross-linked PTFE

Figure 3A - PTFE

Figure 3C - FI-PTFE

Weld Load Kg
X = A: ZDDP
Y = B: PTFE
Z = C: Catalyst

Actual Factor
D: MolySulfide = 0.50

Weld Load Kg
X = A: ZDDP
Y = B: PTFE
Z = C: Catalyst

Actual Factor
D: MolySulfide = 1.25

Weld Load Kg
X = A: ZDDP
Y = B: PTFE
Z = C: Catalyst

Actual Factor
D: MolySulfide = 2.00

| | |
|---|---|
| 1 | 0.5 ZDDP, 0 PTFE, 0.5 Mo, 0.2 Cat |
| 2 | 0.5 ZDDP, 2 PTFE, 0.5 Mo, 0.2 Cat |
| 3 | 2 ZDDP, 0 PTFE, 0.5 Mo, 0.2 Cat |
| 4 | 0.5 ZDDP, 2 PTFE, 2 Mo, 0.2 Cat |
| 5 | 1 Cat, 2 Mo |
| 6 | 0.5 ZDDP, 0 PTFE, 0.5 Mo, 1 Cat |
| 7 | 2 ZDDP, 0 PTFE, 2 Mo, 0.2 Cat |
| 8 | 2 ZDDP, 0 PTFE, 0.5 Mo, 1 Cat |
| 9 | 0.5 ZDDP, 0 PTFE, 2 Mo, 0.2 Cat |
| 10 | 2 ZDDP, 2 PTFE, 0.5 Mo, 1 Cat |
| 11 | 0.5 ZDDP, 2PTFE, 0.5Mo, 1Cat |
| 12 | 2 Mo |
| 13 | 0.5 ZDDP, 2Mo, 1 Cat |
| 14 | 2 ZDDP, 0 PTFE, 2 Mo, 1 Cat |
| 15 | ZDDP, 2 PTFE, 2 Mo, 1 Cat |
| 16 | 0.5 ZDDP, 2 PTFE, 2 Mo, 1 Cat |
| 17 | 1.25 ZDDP, 1 PTFE, 1.25 Mo, 0.6 Cat |
| 18 | 2ZDDP, 2PTFE, 0.5Mo, 0.2Cat |
| 19 | 2 ZDDP, 2PTFE, 0.2Cat |
| 20 | 2ZDDP, 2PTFE |
| 21 | 3 ZDDP, 2PTFE |
| 22 | 2 ZDDP, 2 PTFE, 2 Mo, 0.2 Cat |

FIGURE 6B 0.5 ZDDP + 1.0 PTFE +0.2 Catalyst 2 ZDDP + 1.0 PTFE +0.2 Catalyst

HIGH PERFORMANCE LUBRICANT ADDITIVES

TECHNICAL FIELD

The present application relates generally to lubricant additives and, more particularly, to high-performance lubricant additives that enhance desirable lubricant properties of lubricants.

BACKGROUND OF THE INVENTION

Lubricants comprise a variety of compounds selected for desirable characteristics such as anti-wear and anti-friction properties. Often commercial lubricants are compositions containing a lubricant base such as a hydrocarbon oil or grease, to which is added numerous lubricant additives selected for additional desirable properties. Lubricant additives may enhance the lubricity of the lubricant base and/or may provide anti-wear or other desirable characteristics.

Lubricants are used in enormous quantities. For example, more than four billion quarts of crankcase oil are used in the United States per year. However, many lubricants currently in use also have undesirable characteristics. Currently available crankcase oils generally include the anti-wear additive zinc dialkyldithiophosphate (ZDDP), which contains phosphorous and sulfur. Phosphorous and sulfur poison catalytic converters causing increased automotive emissions. It is expected that the EPA eventually will mandate the total elimination of ZDDP or will allow only extremely low levels of ZDDP in crankcase oil. However, no acceptable anti-wear additives to replace ZDDP in engine oils are currently available.

Additionally, lubricant bases used in conventional lubricants usually have lubricant additives added to them to improve lubricity. Many of these lubricant additives do not provide sufficient additional lubricity and/or possess additional undesirable characteristics.

Accordingly, it is an object of the present invention to provide environmentally-friendly anti-wear additives for lubricants, wherein the amounts of phosphorous and sulfur in the anti-wear additive are significantly reduced and approach zero. It is another object of the present invention to produce compounds with desirable anti-wear and anti-friction characteristics.

BRIEF SUMMARY OF THE INVENTION

Embodiments of the invention comprise methods for preparing lubricant additives and lubricants by reacting together organophosphates such as zinc dialkyldithiophosphate (ZDDP) and organofluorine compounds such as polytetrafluoroethylene (PTFE). PTFE used with embodiments of the present invention comprises more than 40 carbon atoms. In one embodiment, ZDDP and PTFE are reacted together at about −20° C. to about 150° C. In a preferred embodiment, ZDDP and PTFE are reacted together at a temperature of about 60° C. to about 150° C. The reaction is allowed to continue from about 20 minutes to about 24 hours. Both supernatants and precipitates formed during the reaction may be used as lubricant additives. These lubricant additives may be added to lubricants such as oils, greases, automatic transmission fluids, crankcase fluids, engine oils, hydraulic oils, and gear oils. In certain embodiments, organophosphates and organofluorine compounds can be added to a lubricant base and then allowed to react under specified conditions.

Other embodiments of the present invention react a mixture of powdered, masticated metal halide with an organophosphate such as ZDDP and an organofluorine such as PTFE to form a lubricant additive or lubricant. In yet other embodiments, other forms of metal halide may be used that are not powdered and/or masticated. The metal halide used is metal fluoride in a preferred embodiment of the invention. In a preferred embodiment, the metal fluoride, ZDDP and PTFE are reacted together at about −20° C. to about 150° C. to form a lubricant additive. The lubricant additive is then added to a lubricant. The lubricants to which the lubricant additive is added are preferably fully formulated GF4 engine oils without ZDDP. However, other lubricants may be used such as those listed above.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 1 is a table of possible organophosphate formulas used with certain embodiments of the present invention;

FIGS. 6A and 6B are charts summarizing the results of ASTM D2596 4-Ball Weld Load experiments used to generate the cube graphs of FIGS. 5A-5C;

DETAILED DESCRIPTION OF THE INVENTION

Embodiments of the present invention provide improved high performance lubricant additives and lubricants that provide enhanced wear protection, lower coefficients of friction, and low cohesive energy surfaces. Lubricant additives provided according to embodiments of the present invention may be added to lubricants such as greases, crankcase oils, hydrocarbon solvents, etc. Embodiments of the present invention generally react together organophosphate compounds and organofluorine compounds, with or without metal halide and/or molybendum disulfide, to produce lubricant additives.

Figure 2A:
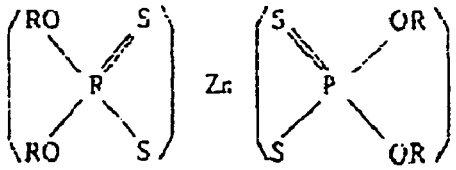
FIGS. 2A-D show various organophosphate structures used with certain embodiments of the present invention.
Figure 2A:
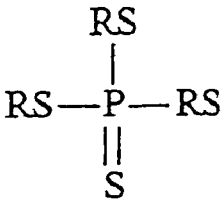
Figure 2A:
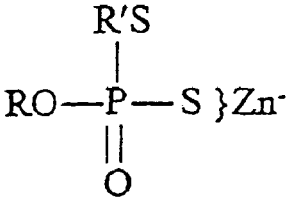
Figure 2A:
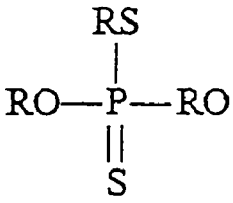
Figure 2A:
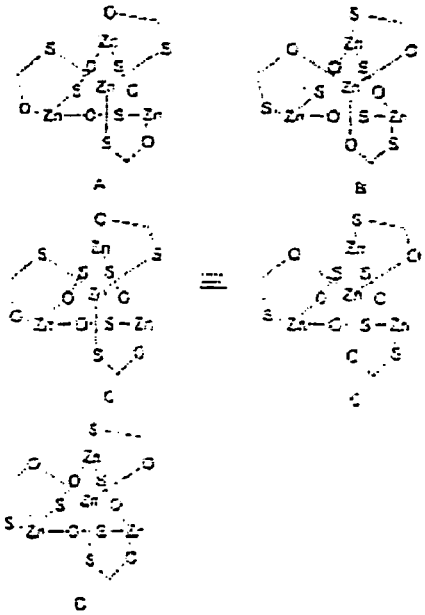
Figure 2B:
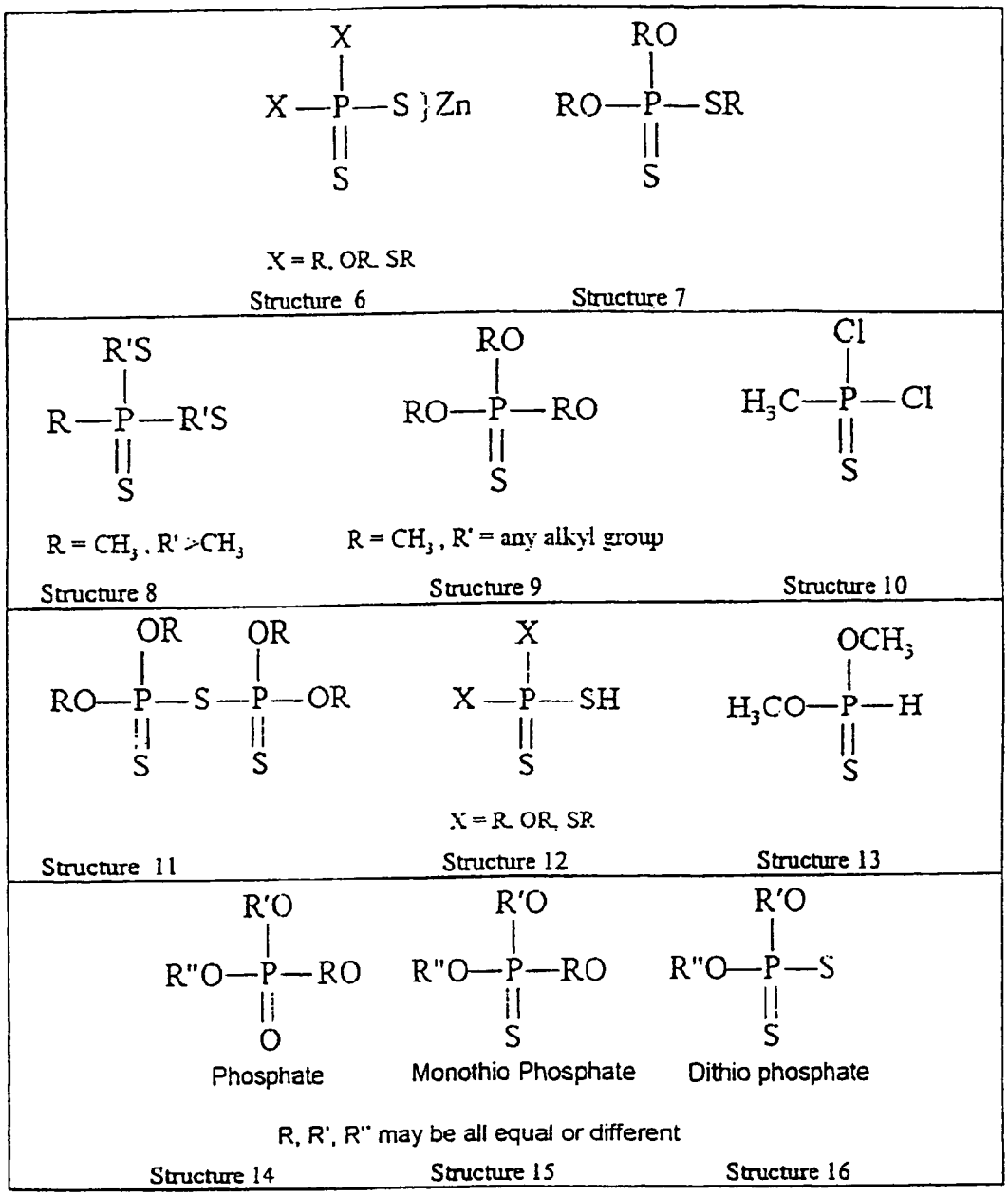
Figure 2C:
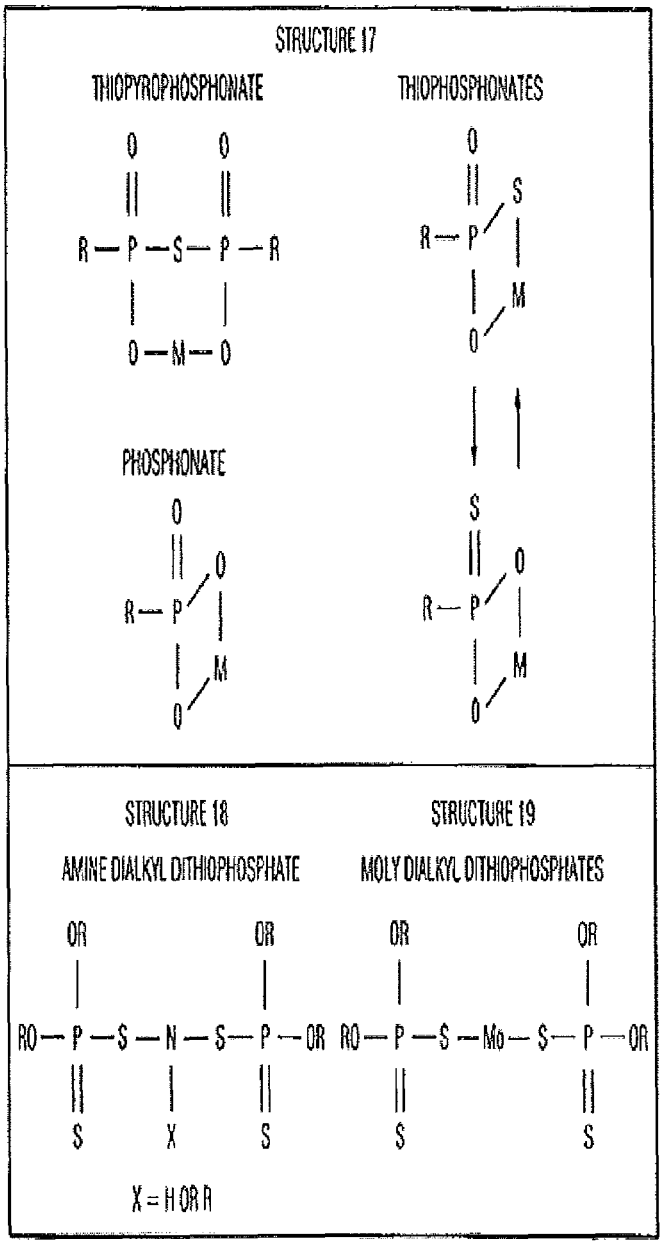
Figure 2C:
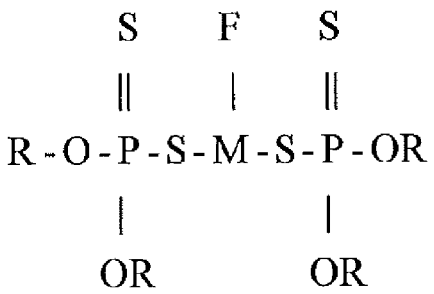

FIG. 1 is a table showing several of the organophosphate compounds that may be used with embodiments of the present invention. Generally, dithiophosphates and ammonium and amine salts of monothiophosphates and dithiophosphates may be used. Metal organophosphates and organothiophosphates such as zinc dialkyldithiophosphate (ZDDP) are encompassed by the term "organophosphate" for the purposes of this disclosure. Other organophosphates listed in FIG. 1 include neutral ZDDP (primary), neutral ZDDP (secondary), basic ZDDP, $(RS)_3P(s)$ where $R>CH_3$, $(RO)(R'S)P(O)SZn^-$, $(RO)_2(RS)PS$ where $R>CH_3$,$P(S)(S)Zn^-$, $(RO)_2P(S)(SR)$,$R(R'S)_2PS$ where $R=CH_3$ and $R'>CH_3$,$(RO)_3PS$ where $R=CH_3$ and R'=alkyl,$MeP(S)Cl_2$, $(RO)_2(S)PSP(S)(OR)_2$,$P(S)(SH)$,$(RO)(R'S)P(O)SZn^-$,$SPH(OCH_3)_2$, where R=any alkyl and R'=any alkyl, and combinations thereof. The chemical structures of representative compounds from FIG. 1 and additional organophosphate compounds that may be used with the invention are shown in FIGS. 2A-2C. In certain embodiments of the present invention, organophosphates not shown in FIGS. 1 and 2A-2C may be used.

The organophosphate ZDDP is used in preferred embodiments of the present invention Embodiments using ZDDP, alone or in combination with other organophosphates, can use ZDDP in one or more moieties. Preferably, the ZDDP used is the neutral or basic moiety. Some of the ZDDP moieties are shown in FIG. 2A as structures 1 and 5. In a preferred embodiment, the ZDDP alkyl groups total approximately 1-20 carbon atoms. The alkyl groups of the ZDDP can assume various forms known to those of skill in the art such as branched- or straight-chain primary, secondary, or tertiary alkyl groups.

Figure 2D:
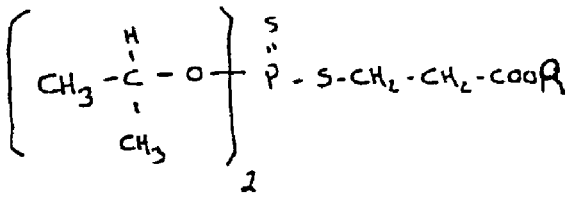
Figure 2D:
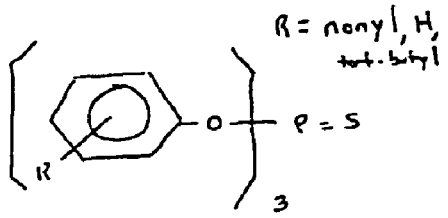
Figure 2D:
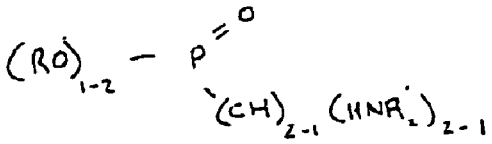
Figure 2D:
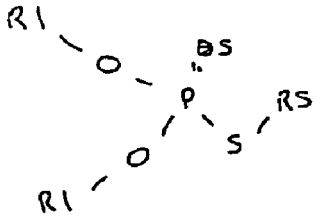
Figure 2D:
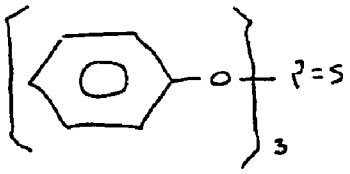
Figure 2D:
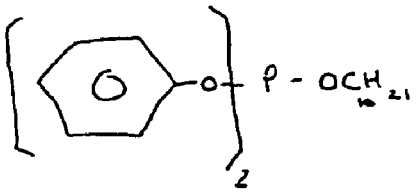
Figure 2D:
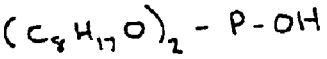
Figure 2D:
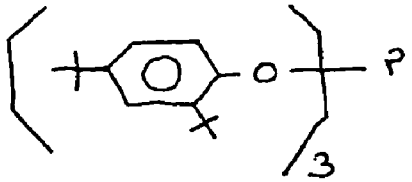

Additional organophosphate structures that may be usable with embodiments of the present invention are shown in FIG. 2D. The organophosphate structures specifically disclosed herein are representative structures and are in no way intended to limit embodiments of the present invention to those structures. Many embodiments of the present invention utilize organophosphate compounds not specifically shown.

Figure 3:
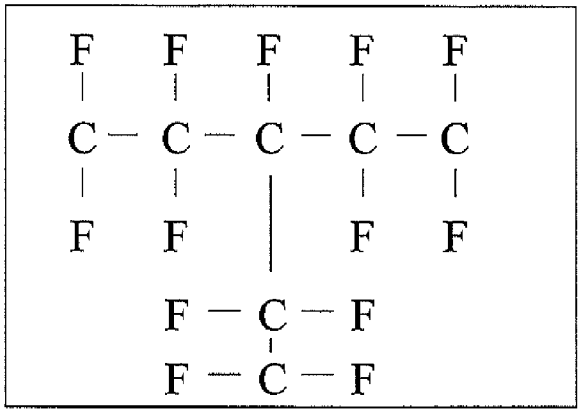
FIG. 3 shows PTFE structures used with certain embodiments of the present invention.
Figure 3:
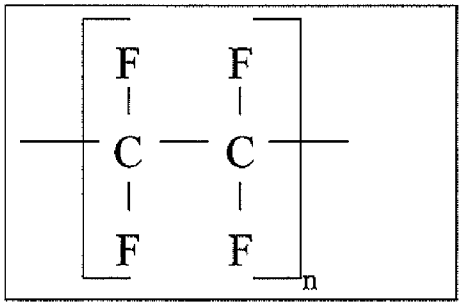
Figure 3:
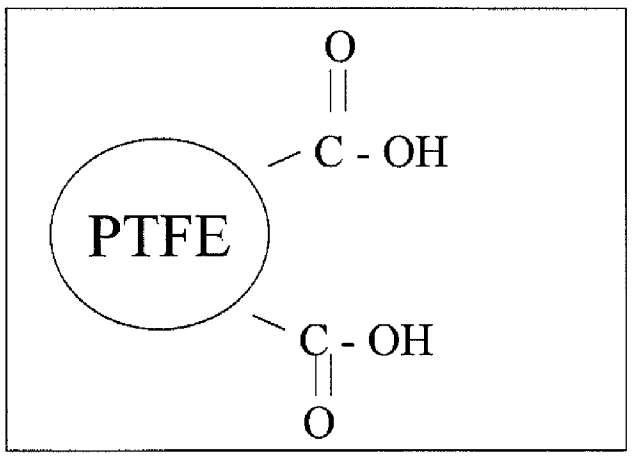

A variety of organofluorine compounds are usable with the present invention. Polytetrafluoroethylene (PTFE) and its derivatives are particularly suited for use with embodiments of the present invention. PTFE structures are shown in FIG. 3. Other organofluorine compounds that are usable include, but are not limited to, fluoroalkyl carboxylic acids, fluoroaryl carboxylic acids, fluoroalkylaryl carboxylic acids, and the like; compositions comprising fluoroalkyl sulfonic acids, fluoroaryl sulfonic acids, or fluoroalkylaryl sulfonic acids, and the like, and their derivatives, such as alkyl and fluoroalkyl esters and alkyl, or fluoroalkyl alcohols and alkyl, or fluoroalkyl amides. Particularly preferred compositions are those described above that have more than one functional group, such compositions including any combination of two or more functional groups including carboxylic acids, sulfonic acids, esters, alcohols, amines and amides, and mixtures thereof. Organofluorine compounds can be partially fluorinated or per fluorinated. Certain of these organofluorine compounds can catalyze the decomposition of organophosphate materials with which they are mixed at a lower temperature than without these materials present. Likewise, these compositions can react with metal fluorides, such as $FeF_3$ and $TiF_3$, $ZrF_4$, $AlF_3$ and the like. In general, organofluorine materials can be of high, low or moderate molecular weight.

Certain embodiments of the present invention comprise methods for preparing lubricant additives by reacting together zinc dialkyldithiophosphate (ZDDP) and polytetrafluoroethylene (PTFE), where the PTFE comprises greater than 40 carbon atoms. PTFE molecules comprising greater than 40 carbon atoms are particularly suited for use with embodiments of the present invention, as this type of PTFE is generally insoluble in mineral oils and other lubricants. A preferred embodiment of the present invention uses PTFE with a composition of between 40 and 6000 carbon atoms. A reaction between PTFE and ZDDP according to embodiments of the present invention may take place outside of a lubricant environment, producing a reaction mixture. The reaction mixture or components thereof can then be added to a base lubricant as a lubricant additive to improve various characteristics of the base lubricant. Alternatively, certain embodiments of the present invention comprise adding a mixture of PTFE and ZDDP to a base lubricant. The reaction between PTFE and ZDDP then takes place in the lubricant environment, either before or during use in a desired application. In preferred embodiments, the base lubricant comprises from about 0.01 weight percent phosphorous to about 0.1 weight percent phosphorous.

Organofluorine compounds such as PTFE compounds used in embodiments of the present invention can be of various molecular weights and of various particle sizes. PTFE molecular weights of about 2500 to about 300,000 are used in certain embodiments of the invention. PTFE particle sizes in certain embodiments of the present invention range from about 50 nm to about 10 μm. In preferred embodiments, the PTFE used is added as a solid in the form of approximately 50-500 nm diameter particles. FIG. 1B shows exemplary molecular structures of PTFE that may be used in certain embodiments of the present invention.

Also used in preferred embodiments is an electron-beam irradiated PTFE. Irradiated PTFE comprises additional active end groups formed by carrying out the irradiation process in an air environment. During the process, the long-chain PTFE molecules are cleaved to form shorter-chain molecules with polar end-groups such as carboxyl groups. Charged PTFE molecules with carboxyl groups present can be attracted to metal surfaces, as explained in SAE Publication No. 952475 entitled "Mechanism Studies with Special Boundary Lubricant Chemistry" by Shaub et al., and SAE Publication No. 941983 entitled "Engine Durability, Emissions and Fuel Economy Studies with Special Boundary Lubricant Chemistry" by Shaub et al., the contents of which are herein incorporated by reference. Irradiated PTFE combined with an organophosphate such as, for example, ZDDP, can enhance the rate of decomposition of ZDDP and form reaction products that are usable as high-performance lubricant additives.

In certain embodiments of the present invention, ZDDP and PTFE are reacted together by adding suspended solid-form PTFE to a ZDDP suspension under specified conditions. In a preferred embodiment, the PTFE used is irradiated PTFE, such as Nanoflon™ powder manufactured by Shamrock Technologies, Inc., and NF1A manufactured by DuPont.

In yet other embodiments, SLA-1612 (a dispersion of PTFE in oil) manufactured by Acheson Industries, Inc. is used. However, various commercial and non-commercial PTFE compounds may also be used in embodiments of the present invention. Also in a preferred embodiment, ZDDP is contained in a suspension comprising 68% ZDDP by weight in paraffin or hydrocarbon oil. However, ZDDP can be suspended in other liquid phase compounds known to those of ordinary skill in the art.

Once combined, the ZDDP and PTFE are reacted by baking at a temperature of about −20° C. to about 150° C. In a preferred embodiment, the reactant mixture is reacted at a temperature of about 60° C. to about 150° C. The reaction is allowed to continue from about 20 minutes to about 24 hours. Generally, as temperature is decreased in embodiments of the invention, the duration of the reaction is increased. Various additional reaction parameters may be used, such as performing the reaction under certain gases such as air, oxygen, nitrogen or noble gases, or stirring the reactants to encourage reaction progress, or by applying ultrasonication to effect faster reactions. Both supernatants and precipitates formed during a reaction may be used as lubricant additives in certain embodiments of the present invention. Supernatants and precipitates may be separated using standard techniques such as filtration or centrifugation known to those skilled in the art.

Figure 4B:
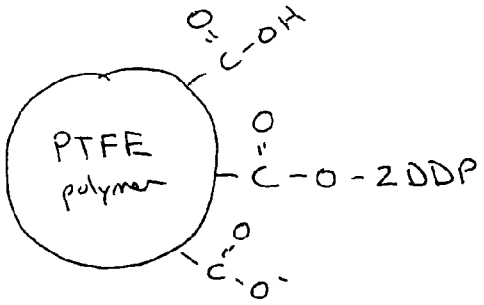
FIGS. 4A and 4B show reaction products of certain embodiments of the present invention.
Figure 4A:
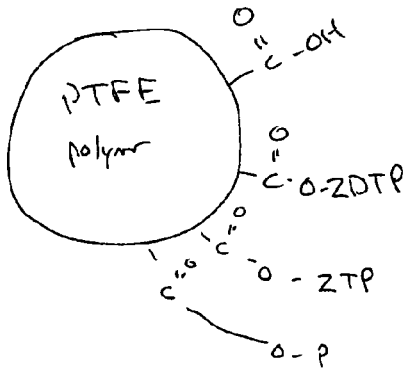

In a preferred embodiment, an intent of a reaction as described above is to produce two products. One is a clear decant liquid which comprises neutral ZDDP, fluorinated ZDDP and/or a PTFE complex that has attached ZDDP, phosphate, and thiophosphate groups. The first product can be used for oils as a low-phosphorous, high performance additive and in greases as a high performance additive. The second product comprising settled or centrifuged solid products comprises predominantly PTFE and PTFE complexes with ZDDP, phosphates and thiophosphates, and can be used as a grease additive. Both of the reaction products are believed to have affinity for metal surfaces. When used (or formed, as described further below) in a lubricating composition, the reaction products bind to, or concentrate on, the metal surface, providing wear and friction protection. FIGS. 4A and 4B show PTFE/ZDDP complexes that are possible reaction products that may form in certain embodiments of the present invention. However, these are only an exemplary product and additional structures may be formed in these or other embodiments of the present invention. Although ZDDP and PTFE are a focus of the discussion above, other organophosphates and organofluorine compounds are expected to produce similar reaction products usable as high-performance additives.

In certain embodiments, one or more compounds with reactivity, so as to accelerate or effect a reaction, can be added to a reaction mixture of ZDDP and PTFE. These reactive agents can speed up the reaction with ZDDP, PTFE, or both, or other materials with these compositions, to give new lubricant additives. Metal halides such as ferric fluoride are reactive materials used in preferred embodiments of the present invention. Metal halides used with certain embodiments of the present invention may be, for example, aluminum trifluoride, zirconium tetrafluoride, titanium trifluoride, titanium tetrafluoride, and combinations thereof. In other embodiments, other transition metal halides are used, such as, for example, chromium difluoride and trifluoride, manganese difluoride and trifluoride, nickel difluoride, stannous difluoride and tetrafluoride, and combinations thereof. Ferric fluoride may be produced according to a process described in co-pending U.S. patent application Ser. No. 10/662,992 filed Sep. 15, 2003, the contents of which are herein incorporated by reference. In embodiments that react metal halides with ZDDP and PTFE, resulting reaction mixtures may comprise both solid and liquid phase components. Liquid phase product comprising fluorinated ZDDP and PTFE complexes with attached ZDDP, phosphate, and thiophosphate groups can be used for both oils and greases as a low-phosphorous and high-performance additive respectively. Solid phase product comprising settled or centrifuged solid products comprises predominantly PTFE and unreacted ferric fluoride and can be used as a grease additive. Both of the reaction products are believed to have affinity for metal surfaces. Solid phase components may be similar to those illustrated in FIGS. 4A and 4B. Additional compounds may result from such reactions that may have minor lubricating characteristics.

Irradiated PTFE is particularly suited for use with reaction mixtures comprising organophosphates and metal halides, as it interacts strongly with such compounds resulting in reaction products usable as high performance lubricant additives. Medium to high molecular weight perfluoro alkyl carboxylic acids, or substantially fluorinated alkyl, aryl, or alkylaryl carboxylic acids are also particularly suited for use with embodiments of the present invention. Organofluorine compounds such as fluoroalkyl, fluoroalkylaryl, fluoroaryl, and fluoroarylalkyl alcohols and amines of all molecular weights are also usable with embodiments of the present invention. Particularly preferred compositions are those described above that have more than one functional group, such as compositions comprising any combination of two or more functional groups comprising carboxylic acids, sulfonic acids, esters, alcohols, amines and amides and mixtures thereof. In certain embodiments of the present invention, organofluorine compounds used are soluble in neutral oils at room temperature.

In a preferred embodiment of the present invention, a lubricant additive or additives produced as described above are mixed with a fully formulated engine oil without ZDDP. The term "fully formulated oil" as used here to illustrate certain embodiments of the present invention are engine oils that include additives, but not ZDDP. In certain embodiments, the fully formulated oil may be, for example, a GF4 oil with an additive package comprising standard additives, such as dispersants, detergents, and anti-oxidants, but without ZDDP. A reaction between ZDDP and PTFE can then be obtained before or during the intended use of the lubricant.

Figure 5A:
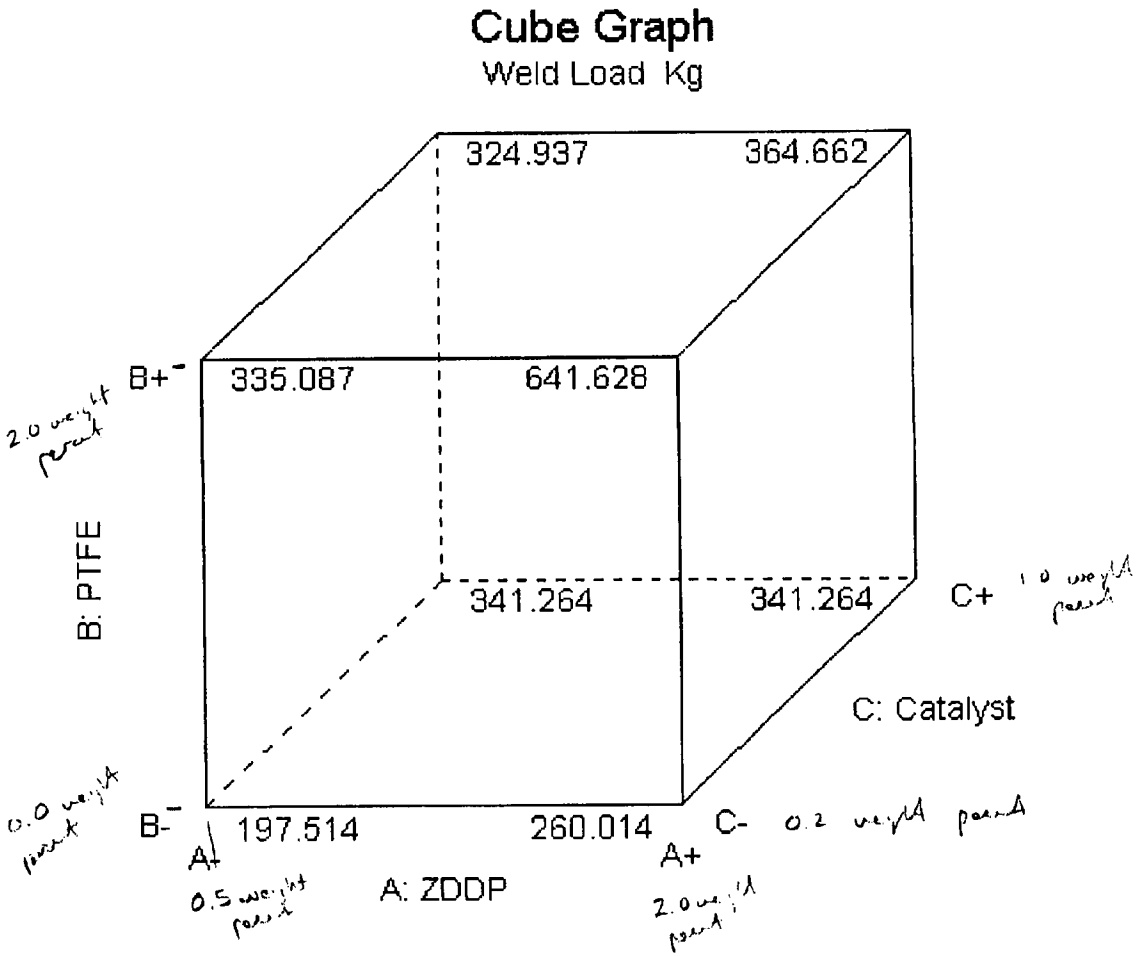
FIGS. 5A-5C show graphs illustrating the results of ASTM D2596 4-Ball Weld Load experiments in which lubricant grease containing various quantities of ZDDP, PTFE, catalyst, and/or molybendum disulfide were present.
Figure 5B:
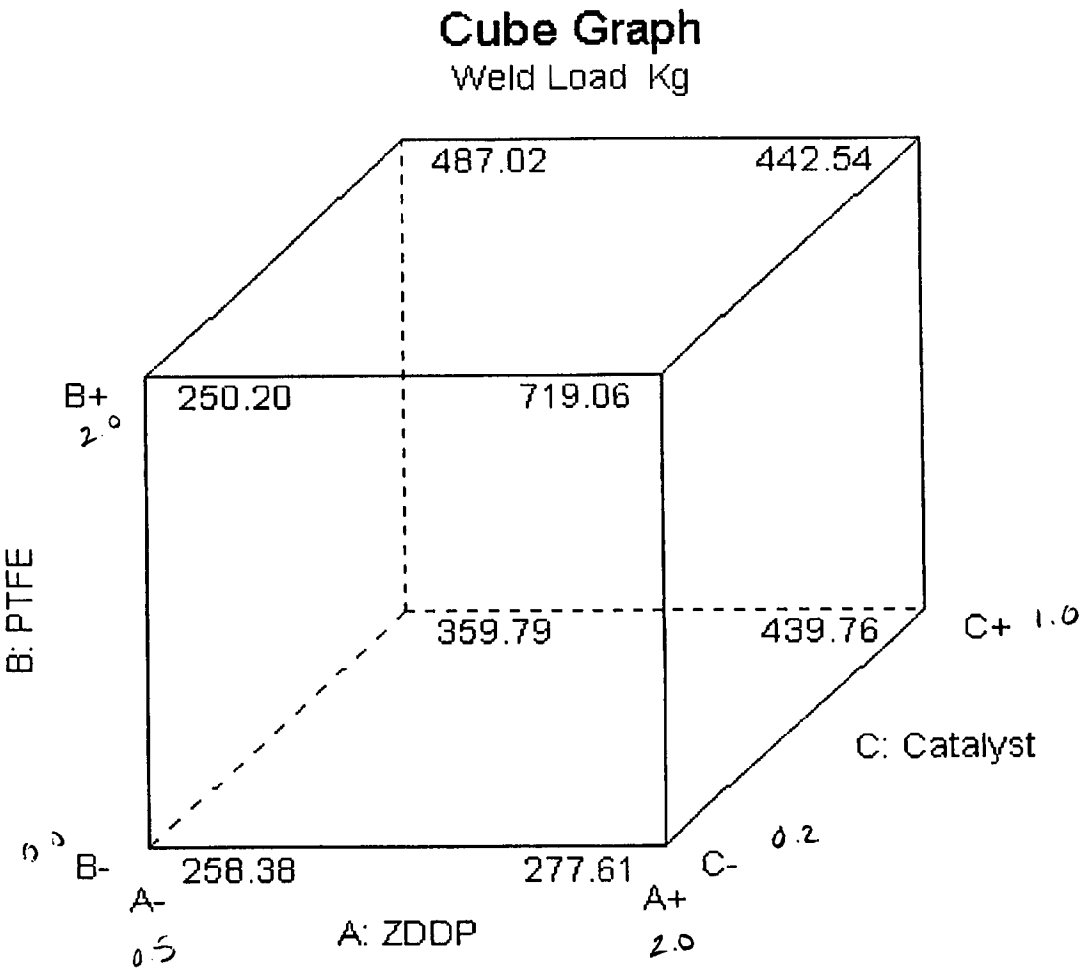
Figure 5C:
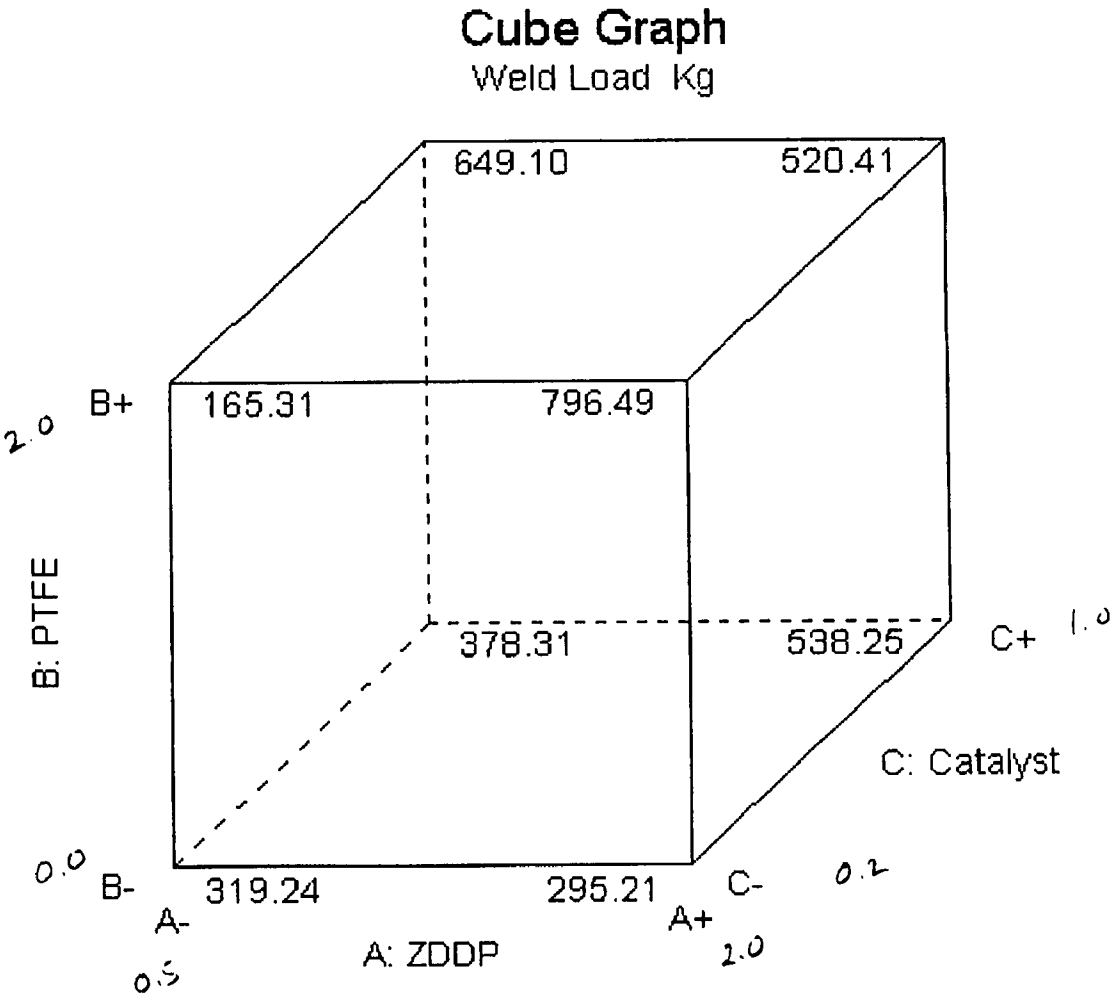

In certain embodiments of the present invention, a reaction between an organophosphate and an organofluoride further comprises interaction of the reactants with molybendum disulfide as a reactant or catalyst. In yet other embodiments, a metal halide composition is added to the mixture to further enhance lubricant properties of the resulting reaction products. As shown below in the experimental results of FIGS. 5A-5C, molybendum disulfide can enhance the lubricant properties of lubricant additives by the formation of possible molybendum disulfide complexes with reaction products formed by the organophosphate and organofluoride reactants. However, other mechanisms may be responsible for the synergistic effect of molybendum disulfide as illustrated in FIGS. 5A-5C. Synergistic effects occur, for example, when a first compound alone produces a first effect and a second compound alone produces a second effect, but the compounds combined together produce an effect that is greater than the sum of the effects of the compounds when used alone.

Below are presented the results from a series of experiments that were performed to determine the properties of lubricants and lubricant additives produced according to embodiments of the present invention.

4-Ball Weld Test (ASTM D2596)

This experimental protocol measures the extreme-pressure properties of lubricants such as greases. A first ball rotating at 1800 rpm is placed in sliding contact with three other balls. The contact force between the first ball and the other three balls is adjustable, and the entire four-ball assembly is bathed in the lubricant being tested. During this test, the contact force between the balls, or test load, is raised in stages until the balls weld together at a point known as the weld load. A higher weld load is more desirable and is generally a characteristic of compounds with better lubrication properties. FIGS. 5A-5C show graphs illustrating the results of experiments in which lubricant grease containing various quantities of ZDDP, PTFE, catalyst, and/or molybendum disulfide were present. The results shown in FIGS. 5A-5C are predicted values of weld loads based on a design of experiments wherein several chemistries of greases were tested and the data used to predict the outcome for the chemistries listed. The actual data used for the predicted values are listed in FIGS. 6A and 6B.

FIG. 5A is a graph showing the weld load for greases comprising varying amounts of ZDDP and PTFE with 0.5 weight percent molybendum disulfide. At a 2.0 weight percent concentration of ZDDP and PTFE, respectively, with minimum ferric fluoride catalyst present, the weld load for the composition was determined to be approximately 642 kg compared to a base weld load of approximately 197 kg.

The compositions tested to generate the results shown in FIG. 5B comprised varying amounts of ZDDP and PTFE together with 1.25 weight percent molybendum disulfide. Here, the weld load was determined to be approximately 719 kg at a 2.0 weight percent concentration of ZDDP and PTFE with minimum ferric fluoride catalyst present. The base weld load of grease with 1.25 weight percent molybendum disulfide is approximately 258 kg.

The compositions tested to generate the results shown in FIG. 5C comprised varying amounts of ZDDP and PTFE together with 2.0 weight percent molybendum disulfide. Ferric fluoride catalyst (0.2 weight percent) was present. In other embodiments, ferric fluoride at a concentration of about 0.1 to about 1.0 weight percent may be used. At a 2.0 weight percent concentration of ZDDP and PTFE, respectively, the weld load for the composition was determined to be approximately 796 kg with minimum ferric fluoride catalyst present. The base weld load of grease with 2.0 weight percent molybendum disulfide is approximately 319 kg.

The results of the experiments shown in the graphs of FIGS. 5A-5C indicate that increasing the concentration of molybendum disulfide provides an increase in the lubricant properties of the grease formulation, although the increase is quite modest compared to the effect of adding ZDDP and PTFE to the grease. The graphs show that a synergistic interaction between ZDDP and PTFE is present, as ZDDP and PTFE by themselves do not provide significant extreme-pressure protection. The addition of 2.0 weight percent ZDDP and PTFE to the grease more than doubled the weld load for the grease composition compared to the base grease and molybendum disulfide alone. The addition of ferric fluoride catalyst also produced a synergistic effect with PTFE when PTFE was added in the absence of ZDDP to the grease/molybendum disulfide composition. This effect was greatest at higher molybendum disulfide concentrations. A lesser synergistic effect with ferric fluoride catalyst was also present with grease/molybendum disulfide compositions containing ZDDP in the absence of PTFE.

Figure 6A:
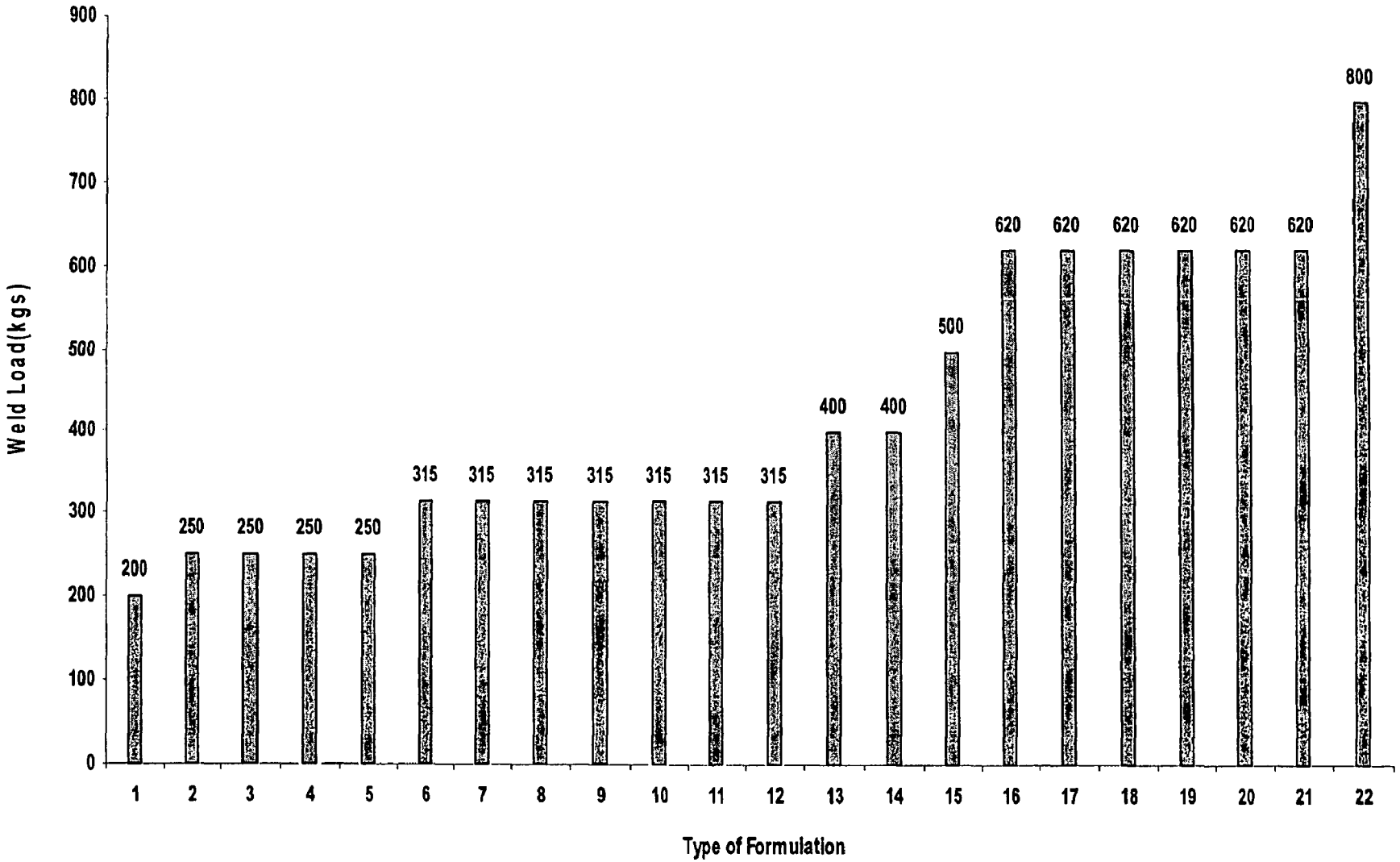

FIG. 6A is a bar chart summarizing the results of the experiments used to generate the cube graphs of FIGS. 5A-5C. The highest weld load obtained (796 kg) was with a grease composition of 2.0 weight percent ZDDP, PTFE, and molybendum disulfide together with 0.2 weight percent ferric fluoride catalyst. FIG. 6B is a legend corresponding to the horizontal axis labels of FIG. 6A. The results shows that a 620 kg weld load can be obtained with just 2 percent ZDDP and 2 percent PTFE and no other ingredients, indicating a strong synergism between PTFE and ZDDP.

Block on Cylinder Tests (Modified Timken Tests)

Figure 7:
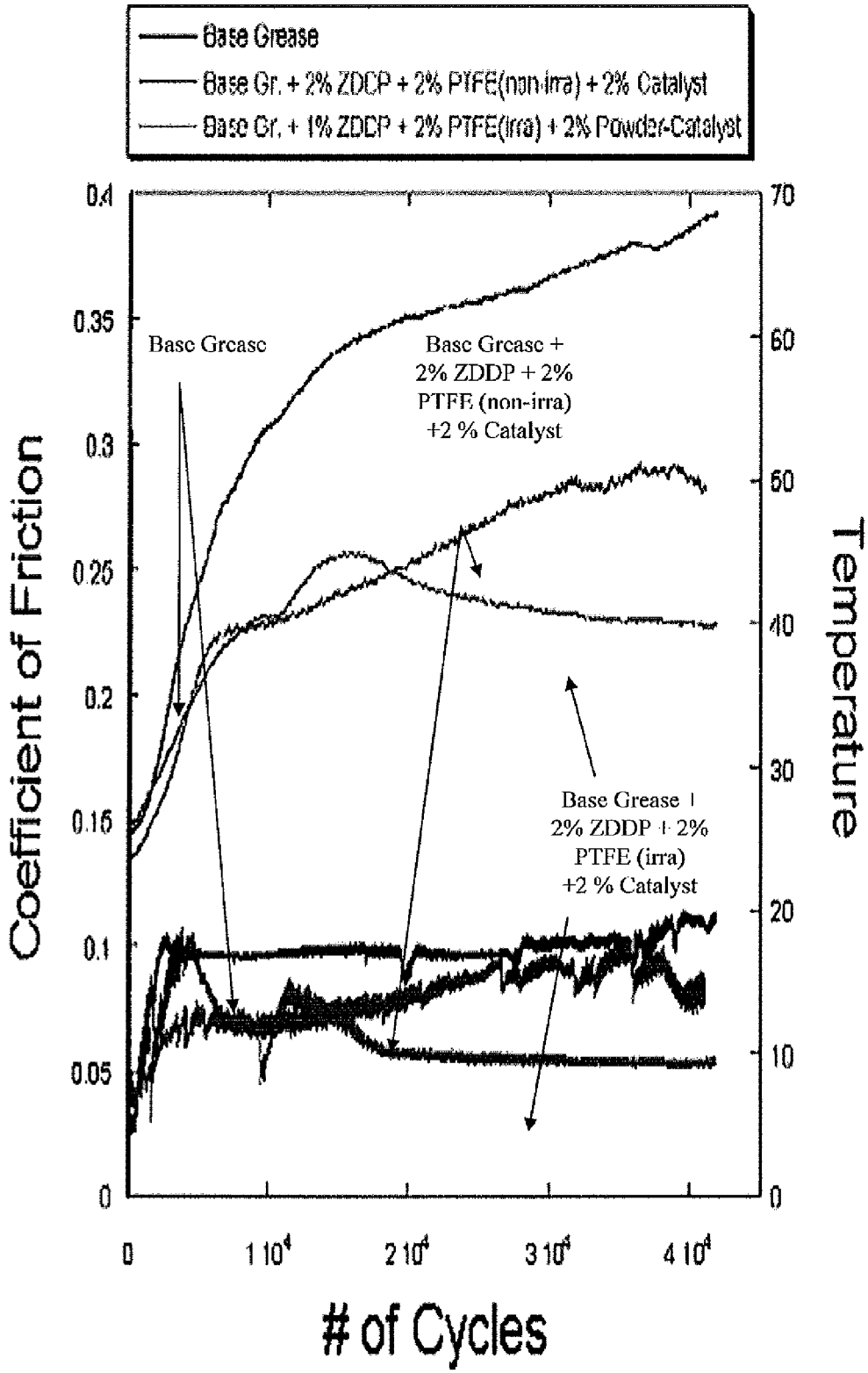
FIG. 7 is a graph summarizing the results of a block on cylinder test for various lubricants.
Figure 8:
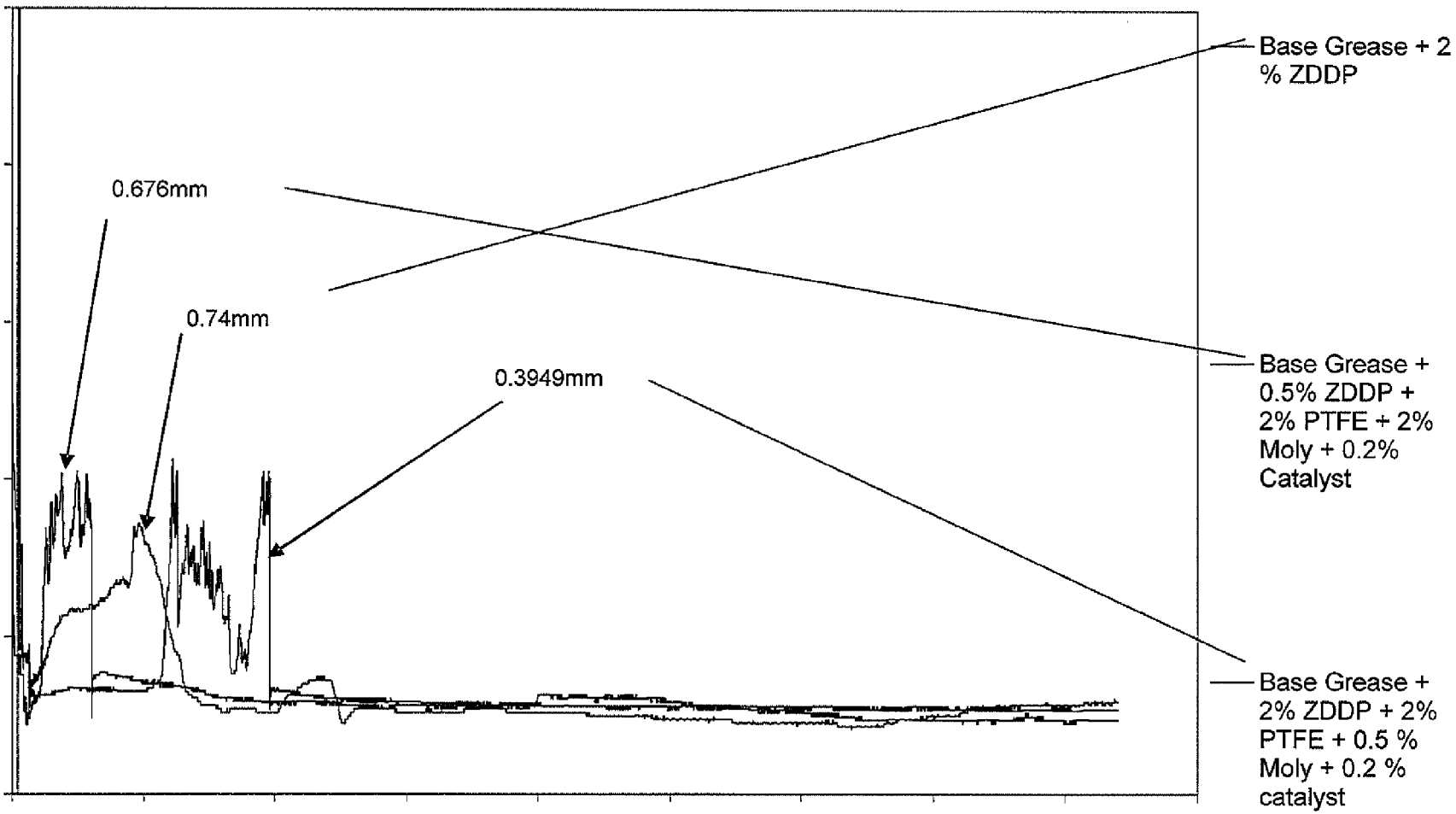
FIG. 8 is a graph of experimental results from a block on cylinder test comparing several grease compositions.
Figure 9:
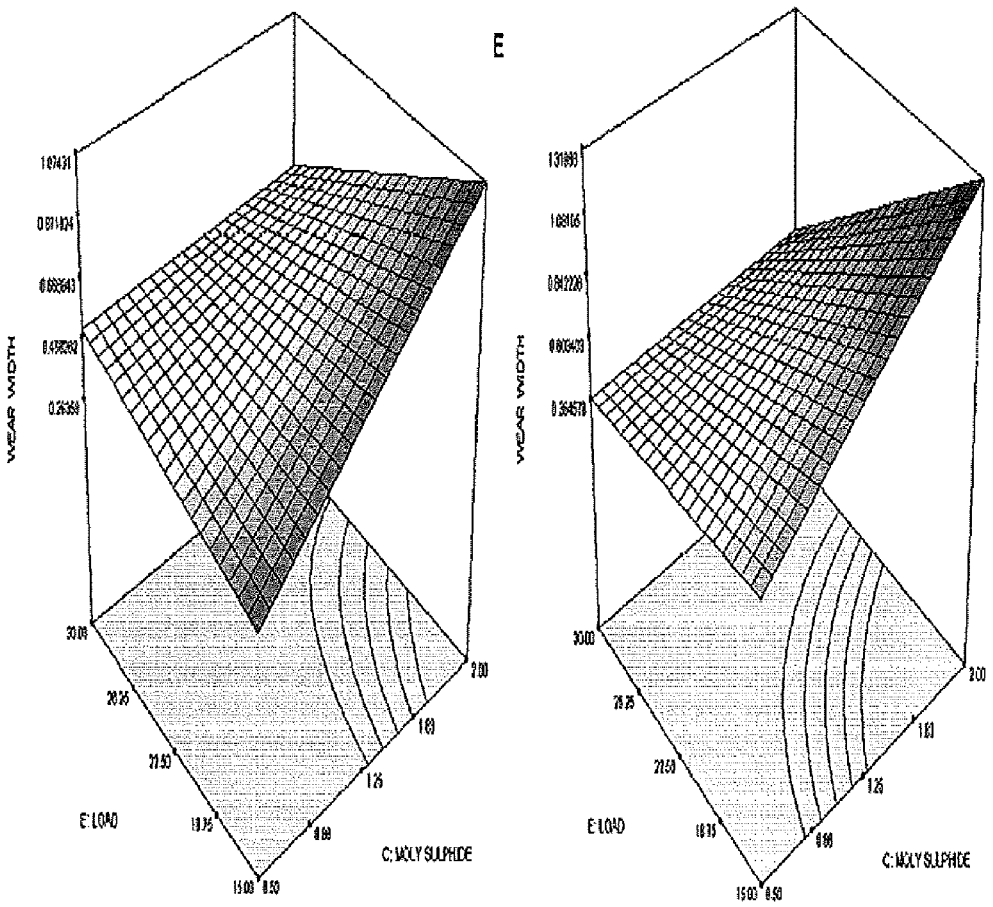
FIG. 9 shows 3 dimensional predictions of wear scar dimensions based on experimental results from block on cylinder tests comparing grease compositions.

FIGS. 7-9 show the results of block on cylinder tests that model the wear life properties of lubricants under the rotating motion of a ring against a block. A cylinder, with 4 grams of the test lubricant applied uniformly on its outer surface, is rotated at 700 rpm against a test block. The test block is raised from underneath the cylinder and contacts the cylinder with a pre-determined load applied by a pneumatic system. The width of the wear scar on the block is used as a measure of wear performance. The coefficient of friction and test temperature are determined as part of the test. The tests were conducted for a total of one hour at a load of 20 kg for 42,000 cycles.

FIG. 7 shows that lubricant compositions comprising irradiated PTFE performed better than non-irradiated PTFE. A base grease composition showed the highest coefficient of friction (>0.35) and the highest temperature at the completion of the test run. A composition comprising base grease, 2.0 weight percent ZDDP, 2.0 weight percent non-irradiated PTFE, and 2.0 weight percent powdered ferric fluoride catalyst performed significantly better, with a coefficient of friction of approximately 0.26 and a test temperature of about 15° C. The test composition comprising base grease, 2.0 weight percent ZDDP, 2.0 weight percent irradiated PTFE, and 2.0 weight percent powdered ferric fluoride catalyst performed the best, with a coefficient of friction of approximately 0.22 and a test temperature of about 10° C. In the absence of additives, the contact temperature increases continuously and no protective film is formed on the surface. The graph of the composition comprising irradiated PTFE evidences the formation of a protective tribofilm on the surface and a corresponding drop in temperature of the test block. Optical micrographs (not shown) indicate that the grease composition with irradiated PTFE produces the narrowest and shallowest wear scar of the three tested compositions. The results summarized in FIG. 7 indicate that compositions comprising irradiated PTFE perform better than compositions comprising non-irradiated PTFE, even with lower ZDDP content.

FIG. 8 is a graph of experimental results from a block on cylinder test comparing several grease compositions. The graph shows the calculated coefficients of friction for several experimental compounds. A base grease composition with 2.0 weight percent ZDDP produced a wear scar width of 0.74 mm. A grease composition comprised of base grease, 0.5 weight percent ZDDP, 2.0 weight percent PTFE, 2.0 weight percent molybendum disulfide, and 0.2 weight percent ferric fluoride catalyst produced a wear scar width of 0.676 mm. The best result was obtained with a grease composition of base grease, 2.0 weight percent ZDDP, 2.0 weight percent PTFE, 0.5 weight percent molybendum disulfide, and 0.2 weight percent ferric fluoride catalyst, which produced a wear scar of 0.3949 mm. This data set indicates a synergistic interaction between ZDDP, PTFE and ferric fluoride yields low coefficients of friction and the best wear results.

FIG. 9 shows 3 dimensional predictions of wear scar dimensions based on experimental results from block on cylinder tests comparing grease compositions. The load used was 30 kg in these tests. The wear scar from a grease composition comprising 0.5 weight percent ZDDP was determined to be 0.456 mm, while the same grease composition comprising an increased 2.0 weight percent ZDDP produced a much smaller wear scar of 0.365 mm. This beneficial behavior of ZDDP is maintained at various molybendum disulfide concentrations. For both compositions, increasing concentrations of molybendum disulfide also increased the wear scar width. For example, at a 2.0 weight percent concentration of ZDDP, the wear scar width was 1.319 mm when the composition comprised 2.0 weight percent molybendum disulfide, and only 1.074 mm with 0.5 weight percent molybendum disulfide. The results indicate that molybendum disulfide is antagonistic to wear performance at low loads, resulting in an increase in wear.

Figure 10:
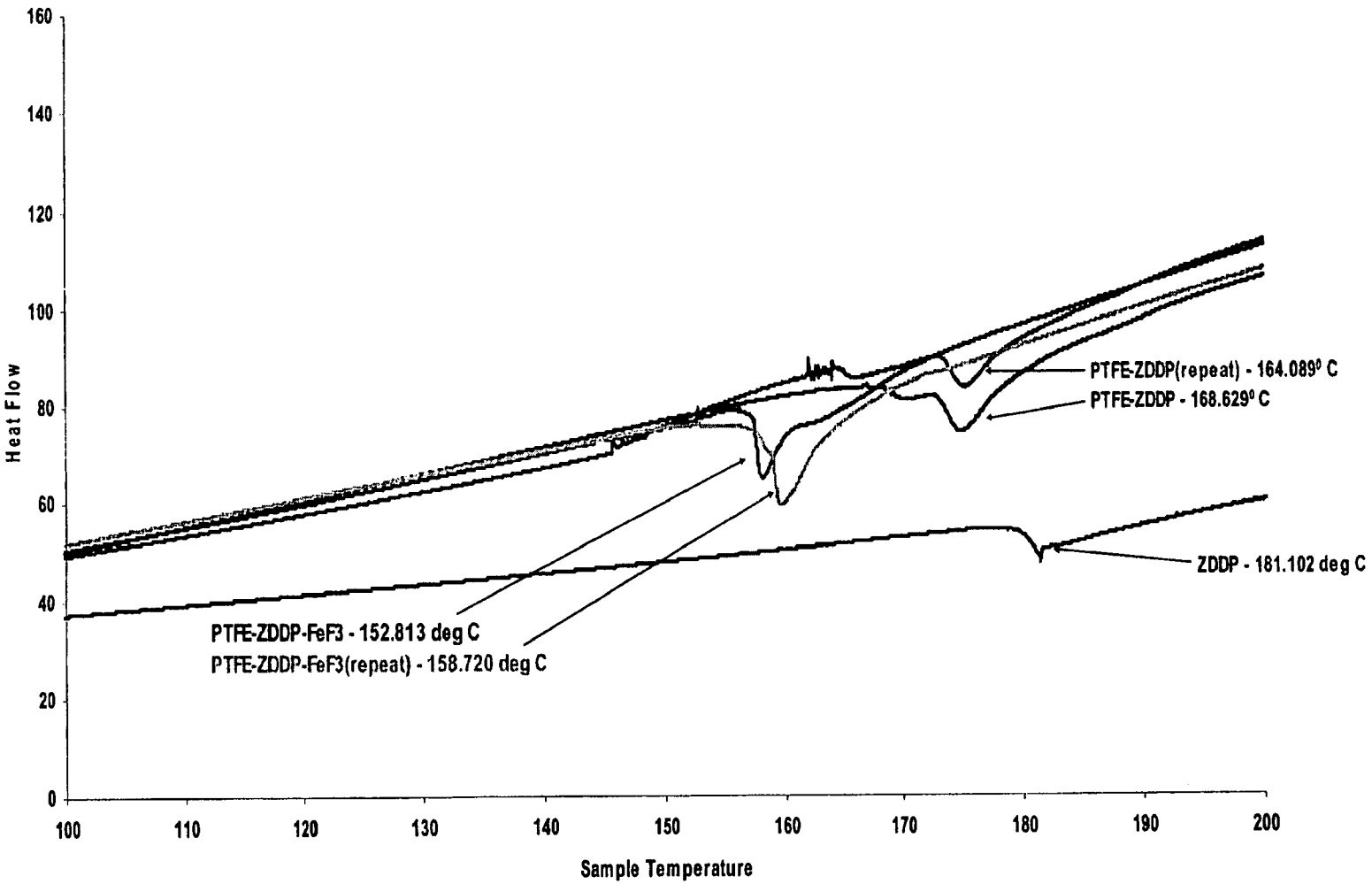
FIG. 10 shows the results of differential scanning calorimetry (DSC) tests to determine the decomposition temperatures of ZDDP.

FIG. 10 shows the results of differential scanning calorimetry (DSC) tests to determine the decomposition temperatures of ZDDP. The DSC tests were performed at −30° C. to 250° C. at a ramp rate of 1° C./minute under nitrogen. The samples were heated in hermetically-sealed aluminum pans. ZDDP alone decomposes at approximately 181° C. In the presence of PTFE (irradiated, Nanoflon™ powder), ZDDP decomposes at approximately 166° C., and decomposes at 155° C. in the presence of PTFE and ferric fluoride catalyst. ZDDP and PTFE were mixed in a 1:1 ratio, and ZDDP/PTFE/ferric fluoride were mixed in a 2:2:1 ratio. The DSC results indicate that in the presence of PTFE the decomposition temperature of ZDDP is reduced by approximately 15° C. In the presence of both PTFE and ferric fluoride, the decomposition temperature is reduced by approximately 26° C.

Ball on Cylinder Test

Figure 11:
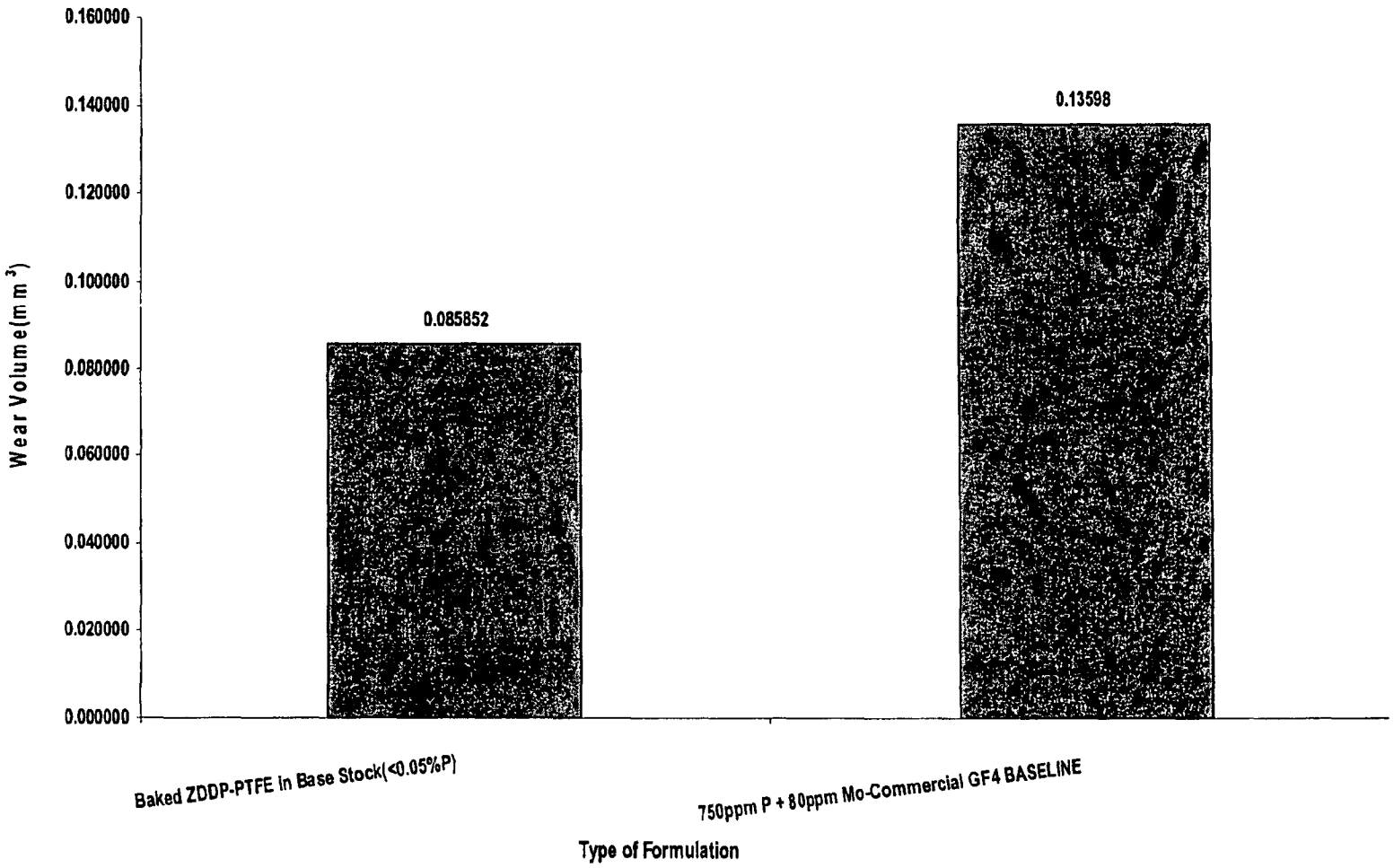
FIG. 11 shows wear volume test results for engine oils from a ball on cylinder test.

FIG. 11 shows wear volume test results for engine oils. The test used is a ball on cylinder test that evaluates the wear-preventing properties of lubricants. A steel cylinder (67 HRC) is rotated at 700 rpm against a tungsten carbide (78 HRC) ball which is loaded with a lever arm to apply a 30 kg load. 50 μL of the test lubricant is uniformly applied through the outer surface of the cylinder at the point of contact with the ball. Wear track depth and wear volume is calculated at the conclusion of the test. The lubricant compositions were prepared as follows. ZDDP and PTFE in a 1:1 ratio were baked in air at 150° C. for 20 minutes and then centrifuged to remove all solids. A measured quantity of the supernatant liquid was added to Chevron 100N base oil to yield less than 0.05 weight percent phosphorous for the lubricant composition. The graph shows that the wear volume for this composition was 0.859 $mm^3$ compared to the wear volume of 0.136 $mm^3$ for a fully formulated commercial GF4 oil comprising 750 ppm phosphorous and 80 ppm molybendum disulfide. The results indicate that the synergistic effects of a ZDDP/PTFE composition are effective in formulations intended for engine usage.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A lubricant additive produced by a process comprising:

mixing an organophosphate and an organofluorine compound selected from the group consisting of functionalized irradiated PTFE(FI-PTFE), fluoroalkyl carboxylic acids, fluoroaryl carboxylic acids, fluoroalkylaryl carboxylic acids, fluoroalkyl sulfonic acids, fluoroaryl sulfonic acids, and fluoroalkylaryl sulfonic acids; and reacting the organophosphate and the organofluorine compound to produce a reaction mixture comprising the lubricant additive.

2. The lubricant additive produced by the process of claim 1 wherein the organophosphate is ZDDP and the organofluorine is functionalized irradiated PTFE (FI-PTFE), where the FI-PTFE molecules comprise greater than 40 carbon atoms.

3. The lubricant additive produced by the process of claim 1 further comprising:

separating said reaction mixture into phases, at least one phase comprising said lubricant additive.

4. The lubricant additive produced by the process of claim 2 wherein the ZDDP is selected from the group consisting of:

neutral ZDDP (primary), neutral ZDDP (secondary), basic ZDDP (primary), basic ZDDP (secondary), ZDDP salt, and combinations thereof.

5. The lubricant additive of claim 1 wherein said organofluorine compound has at least one functional group.

6. The lubricant additive of claim 5 wherein said at least one or more functional group is selected from the group consisting of carboxylic acids, sulfonic acids, ester, alcohols, amines, amides, and mixtures thereof.

7. The lubricant additive produced by the process of claim 1, wherein mixing further comprises mixing molybdenum disulfide with said organophosphate and said organofluorine compound.

8. The lubricant additive produced by the process of claim 1, wherein said mixing further comprises mixing a metal halide with said organophosphate and said organofluorine, and wherein reacting further comprises reacting the metal halide with the organophosphate and the organofluorine.

9. The lubricant additive produced by the process of claim 8 wherein the metal halide is selected from the group consisting of:

aluminum trifluoride, zirconium tetrafluoride, titanium trifluoride, titanium tetrafluoride, ferric fluoride, chromium difluoride, chromium trifluoride, nickel difluoride, stannous difluoride, stannous tetrafluoride, and combinations thereof.

10. The lubricant additive produced by the process of claim 8, wherein said mixing further comprises mixing said metal halide, molybdenum disulfide, said organophosphate, and said organofluorine and wherein said reacting further comprises reacting together the metal halide, molybdenum disulfide, said organophosphate and said organofluorine.

11. The lubricant additive produced by the process of claim 8 wherein the metal halide is about 0.1 to about 1.0 weight percent ferric fluoride.

12. The lubricant additive produced by the process of claim 1 wherein said reacting is of a duration from about 20 minutes to about 24 hours.

13. The lubricant additive produced by the process of claim 1 wherein said reacting comprises reacting at a temperature of about −20° C. to about 125° C.

14. The lubricant additive produced by the process of claim 1 wherein said reacting comprises reacting at a temperature of about 60° C. to about 125° C.

15. A method of manufacturing a lubricant additive comprising:

mixing an organophosphate and an organofluorine selected from the group consisting of FI-PTFE, fluoroalkyl carboxylic acids, fluoroaryl carboxylic acids, fluoroalkylaryl carboxylic acids, fluoroalkyl sulfonic acids, fluoroaryl sulfonic acids, and fluoroalkylaryl sulfonic acids; and reacting the organophosphate with the organofluorine to produce a reaction mixture comprising the lubricant additive; and separating said reaction mixture into solid and liquid phases, at least one phase comprising said lubricant additive.

16. The method of claim 15 wherein said mixing further comprises mixing molybdenum disulfide with said organophosphate and said organofluorine and wherein said reacting further comprises reacting said molybdenum disulfide with said organophosphate and said organofluorine.

17. The method of claim 15, wherein said organophosphate is ZDDP and said organofluorine is FI-PTFE, where the FI-PTFE molecules comprise greater than 40 carbon atoms.

18. The method of claim 15 wherein said lubricant additive is in the solid phase.

19. The method of claim 15 wherein said lubricant additive is in the liquid phase.

20. The method of claim 17 wherein the ZDDP is selected from the group consisting of:

neutral ZDDP (primary), neutral ZDDP (secondary), basic ZDDP (primary), basic ZDDP (secondary), ZDDP salt, and combinations thereof.

21. The method of claim 15 wherein said organofluorine has at least one functional group.

22. The method of claim 21 wherein said organofluorine has at least one or more functional groups consisting of carboxylic acids, sulfonic acids, ester, alcohols, amines, amides, and mixtures thereof.

23. The method of claim 15 wherein said mixing further comprises mixing a metal halide with said organophosphate and said organofluorine, and wherein said reacting further comprises reacting the metal halide with the organophosphate and the organofluorine.

24. The method of claim 23 wherein said mixing further comprises mixing molybdenum disulfide with said metal halide, said organophosphate, and said organofluorine, and wherein reacting further comprises reacting said molybdenum disulfide with said metal halide, said organophosphate, and said organofluorine.

25. The method of claim 15 wherein said reacting comprises reacting from about 20 minutes to about 24 hours at a temperature of about −20° C. to about 125° C.

* * * * *